United States Patent [19]

Berndt

[11] Patent Number: 4,738,648

[45] Date of Patent: Apr. 19, 1988

[54] DEVICE WITH ATTACHABLE TOY BUILDING BRICKS

[76] Inventor: Klaus Berndt, Schäfergasse 3, D-6454 Bruchkoebel, Fed. Rep. of Germany

[21] Appl. No.: 849,508

[22] PCT Filed: Jul. 10, 1985

[86] PCT No.: PCT/EP85/00337

§ 371 Date: Mar. 6, 1986

§ 102(e) Date: Mar. 6, 1986

[87] PCT Pub. No.: WO86/00541

PCT Pub. Date: Jan. 30, 1986

[30] Foreign Application Priority Data

Jul. 11, 1984 [DE] Fed. Rep. of Germany ..... 3425520

[51] Int. Cl.[4] ..... A63H 33/08

[52] U.S. Cl. ..... 446/120; 446/127

[58] Field of Search ..... 446/95, 111, 112, 121, 446/124, 120, 114, 127, 125

[56] References Cited

U.S. PATENT DOCUMENTS

| | | | |
|---|---|---|---|
| 2,752,726 | 7/1956 | Calverley | 446/120 |
| 3,510,979 | 5/1970 | Fischer | 446/127 |

FOREIGN PATENT DOCUMENTS

| | | | |
|---|---|---|---|
| 808333 | 7/1951 | Fed. Rep. of Germany . | |
| 1004980 | 3/1957 | Fed. Rep. of Germany . | |
| 1478616 | 9/1969 | Fed. Rep. of Germany . | |
| 2510334 | 9/1976 | Fed. Rep. of Germany | 446/121 |
| 2748677 | 5/1979 | Fed. Rep. of Germany . | |
| 2373311 | 7/1978 | France . | |
| 428530 | 7/1967 | Switzerland . | |
| 559568 | 3/1975 | Switzerland . | |
| 1021272 | 3/1966 | United Kingdom . | |

*Primary Examiner*—Richard J. Johnson

*Attorney, Agent, or Firm*—Jordan B. Bierman

[57] ABSTRACT

Unit with a game block comprising at least one pluggable head (10) bearing on a neck (24). The insertable head (10) is comprised of a cylindrical medial part (11) and of two truncated terminal parts (12, 13) projecting from the medial part (11) and which extend on either side of the medial part in the longitudinal direction of the insertable head (10). A terminal part (12) is connected to the neck (24) of a diameter smaller than that of the terminal part (12). In the longitudinal cross-section, the insertable head (10) is octagonal. It may be inserted into a recess (3) of another game block. The recess (3) has the shape of a notch and extends in straight line in its longitudinal direction. It is laterally and upwardly open. Inside the recess (3) there are provided two segments (8,9) wherein the insertable head may be clamped at different depths of the game block. The outer segment is formed so as to enable the clamping of the insertable head (10) in different angular positions.

9 Claims, 5 Drawing Sheets

Figure 1A:
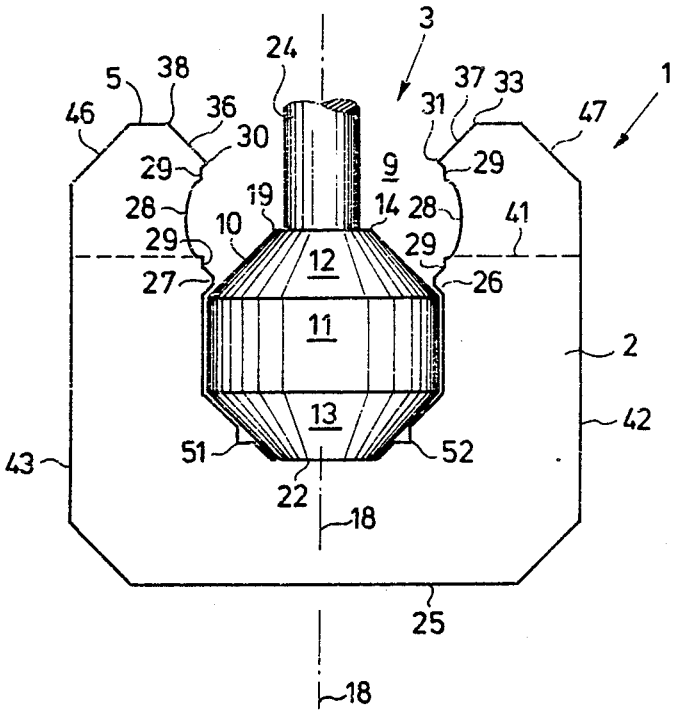

FIG. 4
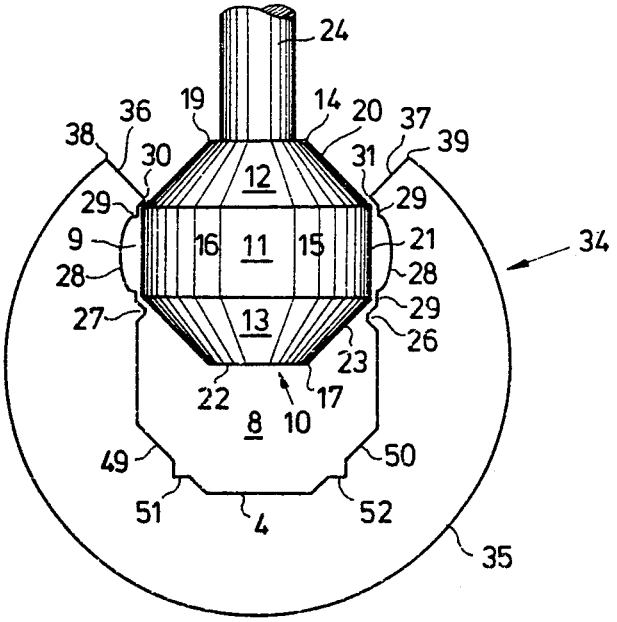
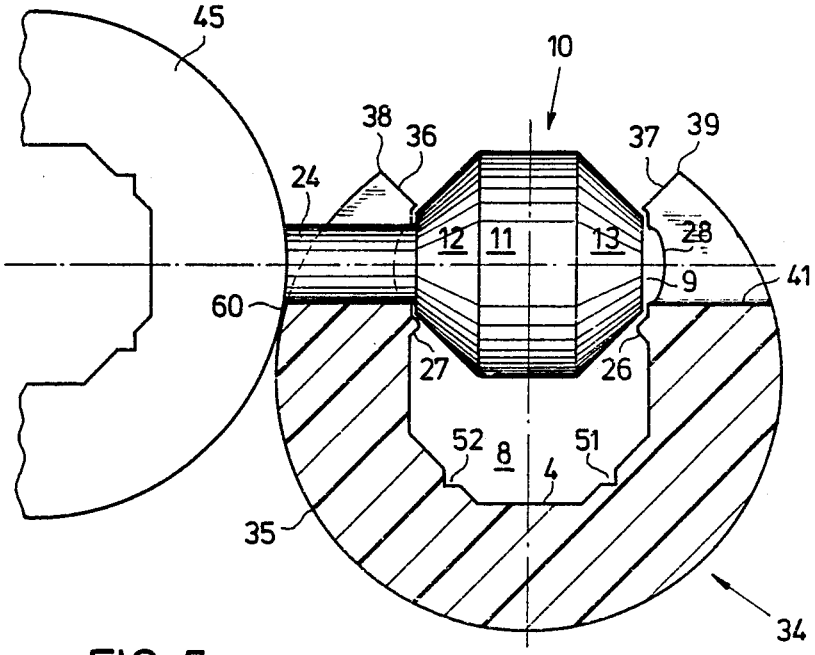
FIG. 5

FIG.6
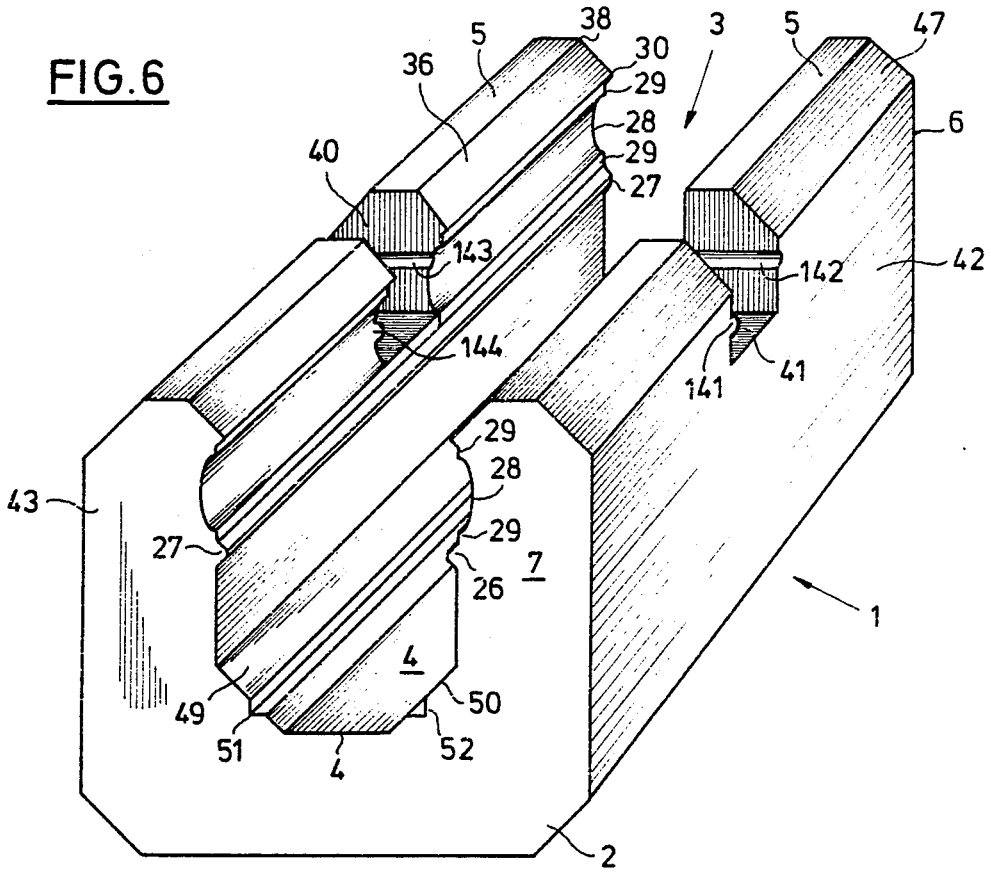
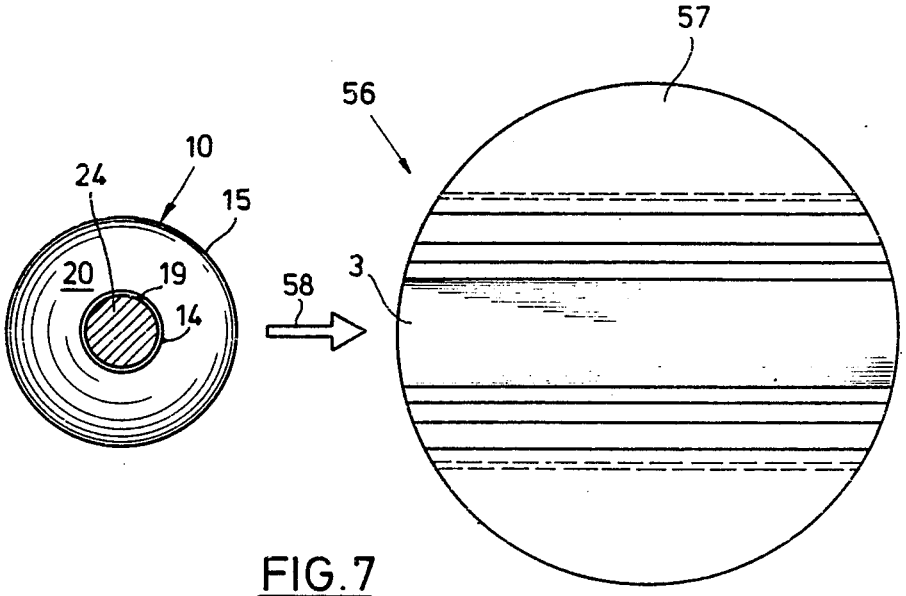
FIG.7

DEVICE WITH ATTACHABLE TOY BUILDING BRICKS

The invention relates to a device with a toy building brick, comprising at least one plug-in head carried on a neck, being composed of a middle piece having a constant cross-section in longitudinal direction of the neck, and two endpieces, each of which on the bases passing over in a front side of the middle piece, which endpieces are projecting from the front sides of the middle piece, being of identical shape and tapering off respectively towards the free end of the plug-in head or towards the neck, of which the outer surface is recessed towards the edge of the endpiece, where the plug-in head is octagonal in longitudinal section and can be lodged in a recess of another toy building brick and arrested alternatively in two different depths.

Such a device is already known (German Specification No. 27 28 677). In that device the middle piece is a cylinder while the end-pieces are formed like truncated cones. The edges of the truncated cones are arranged on an imaginary spherical surface. The recess consists of a main chamber and an antechamber passing over into one another. The main chamber is arranged at a lower level in the interior of the respective toy building brick than the antechamber. While the main chamber is adapted to one truncated cone and to the cylinder, the antechamber has a convex middle section and two elastic projections. The middle section in its shape is adapted to the imaginary spherical surface. The elastic projections are arranged at the input and the output of the antechamber, and after inserting the plug-in head, each of the projections is bordering on a partial area of the surface areas of the truncated cone.

When pushing the plug-in head into the antechamber, the truncated cone and the cylinder will press the elastic projection at the mouth of the antechamber radially outwards till the plug-in head has taken up its holding position in the antechamber. When the plug-in head is inserted in the main chamber, then the projection at the output of the antechamber together with the truncated cone and the cylinder must also be pressed radially outwards. The force that must be applied to radially dislocate the projections, at the same time determines the holding force of the plug-in heads in the antechamber or the main chamber. A higher holding force requires an even higher force to be applied for pushing in and pulling out the plug-in heads.

It is the object of the invention to further develop a device of the kind as described at the beginning in such a manner that plug-in heads can be more easily inserted in recesses and removed therefrom.

According to the invention this problem is solved by the measures as described in claim 1. As the respective recess has not only one opening but is open on two sides opposite to each other, the plug-in heads can be easily pushed in from one of these sides. Thereby it is no longer necessary to press aside projections. The force for inserting and removing the plug-in heads is conditional on the cross section of the respective segment and the elasticity of the material used for the toy building brick. Therefore the projections can be of thicker construction in order to provide a high holding force for the plug-in heads inserted in the recess. The plug-in head can be inserted in the outer section with different positions of the neck. A swinging around the longitudinal axis of the recess effected after inserting the plug-in head in the outer section, will require less force than the inserting of the plug-in head from above.

In an expedient embodiment plane surfaces are arranged between the additional projections and the edges of the recess extending over them, which plane surfaces are moving away from each other outwardly and together with the perpendicular are enclosing an angle of 45° each on the bottom of the recess. The plug-in head can be inserted in the outer section at different angle positions. Thereby the neck is arranged along the perpendicular on the bottom of the recess, or inclined toward the perpendicular at 45°. In this inclined position toward the perpendicular, the neck is resting against the respective plane surface. By this means the neck will get a firmer fit.

Preferably an additional recess can be provided in the toy building brick of which the cross section is adapted to the cross section of the neck, and which recess is crossing the first recess at an angle of 90°, where the bottom of the additional recess is situated at the same level with the edges adjacent to the inner section of the walls of the middle zone. With the additional recesses it is possible to arrange the plug-in head in additional angle positions in the outer section of the respective recess. In these additional angle positions the neck is inclined each time for 90° against the perpendicular on the bottom of the first recess. In order to prevent a slipping out of this position, the neck can be fastened in kind of a stop connection by projections provided in the recess. By means of this embodiment further angle positions will ensue for joining the toy building bricks.

In a favorable embodiment, the toy building brick that has the recess is formed like a squared stone and is bevelled by plane surfaces at least on the two outer longitudinal edges extending on a level with the upper opening of the recess, which plane surfaces are inclined against the perpendicular on the bottom of the recess under 45°. The inclined surfaces can be used as supporting surfaces for those sides of toy building bricks from which the necks with the plug-in heads are projecting. For example it is favorable to adapt the length of the neck to the thickness of the wall between the outer surface of the ashlar-shaped toy building brick and the recess. When a toy building brick from one front side of which a neck of respective length is projecting, is put with the neck into the additional recess, then the front side is leaning against the outer surface of the ashlar-shaped toy building brick. It is then expedient to bevel the edges of the ashlar-shaped toy building brick to such an extent that the toy building brick being provided with the plug-in head, from a position where the neck is inclined under 45° towards the perpendicular on the bottom of the recess, can be swung into a position in the additional recess where the inclination is 90°.

In a further preferred embodiment the toy building brick provided with the recess, has a spherical shape.

Preferably two plug-in heads each will be joined with the ends of a neck. This device is used for joining two toy building bricks via their recesses. The length of the neck is chosen in such a manner that the two toy building bricks will face each other with one side each when one plug-in head in a toy building brick is inserted into the outer section and into the inner section of another toy building brick.

Still another favorable embodiment consists therein that notches are arranged in the areas bordering on both sides on the bottom of the recess, extending in longitudinal direction of the recess. The middle piece and the end-pieces are expediently formed as cylinders or, respectively as truncated cones. However, it is also possible to design the middle piece and the endpieces as a polyhedron with a great number of surfaces. In such an embodiment in each position of the plug-in heads, two surfaces are extending parallelly to the respective surfaces of the recess so that the fit is protected against a turning of the plug-in heads. Corresponding to the number of surfaces, the respective plug-in head can be put into different angle positions.

Figure 1B:
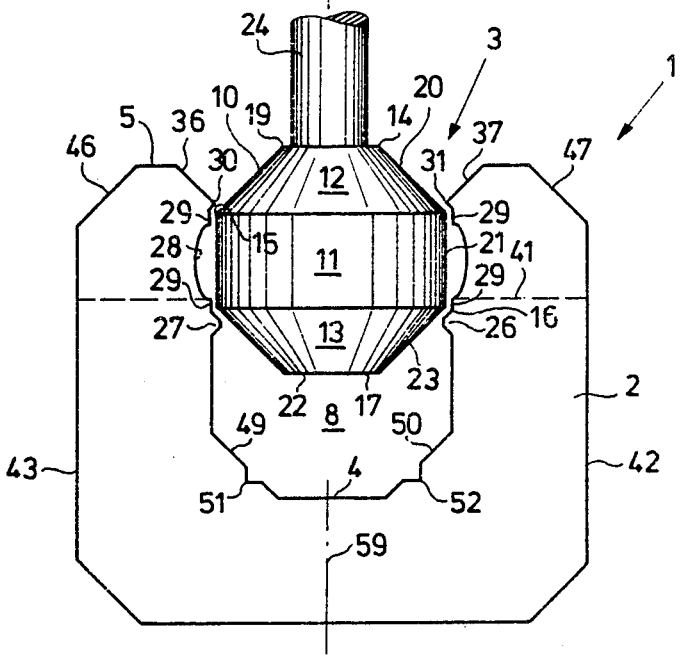
Figure 2:
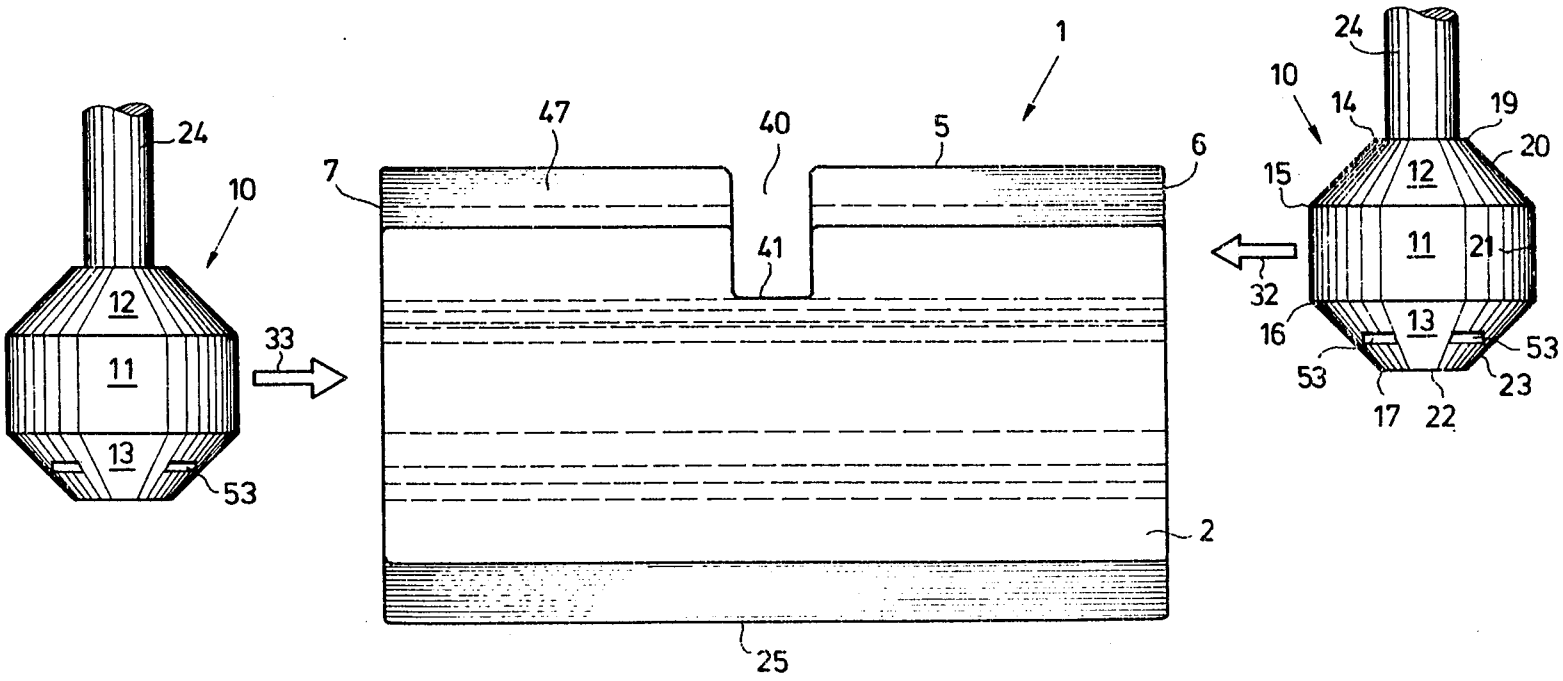
Figure 3A:
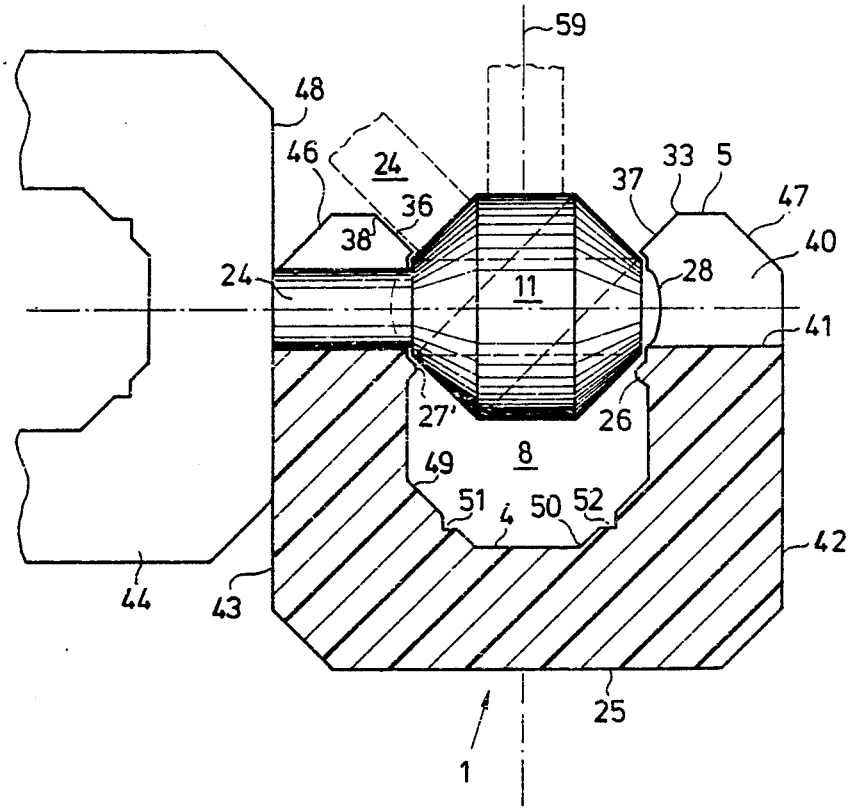
Figure 3B:
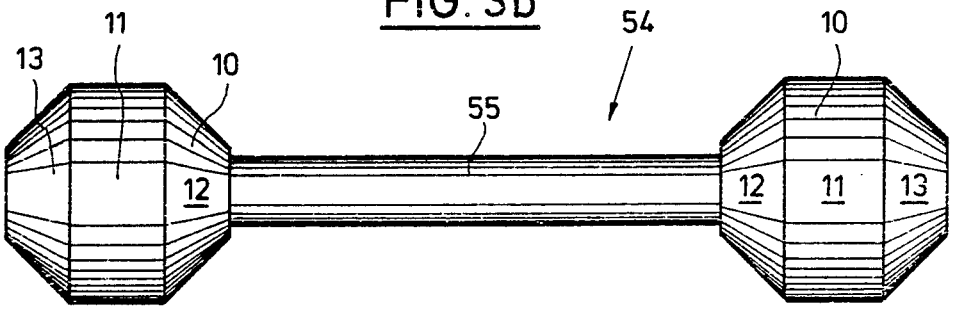

In the following the invention is described in more detail by means of embodiment examples shown in a drawing from which further characteristics as well as advantages will result, and in which FIG. 1*a* is a view from the front of a toy building brick, in which a plug-in head is inserted in a first arresting position, FIG. 1*b* is a view from the front of the toy building brick shown in FIG. 1*a*, with the plug-in head in a second arresting position, FIG. 2 shows the toy building brick according to FIG. 1 in side view, with two plug-in heads being arranged outside the toy building brick, FIG. 3*a* shows two toy building bricks joined together by means of a plug-in head, partially in cutaway drawing, FIG. 3*b* is a joining element composed of a neck with plug-in heads being arranged on both ends of the neck, FIG. 4 is a view from the front of another embodiment of a toy building brick, in which a plug-in head is inserted in a second arresting position, FIG. 5 shows a cross-section through the toy building brick illustrated in FIG. 4, with an inserted plug-in head being attached to another toy building brick, FIG. 6 is a perspective view of the toy building brick provided with a recess as shown in FIGS. 1 and 2, and FIG. 7 is a view from above of the toy building brick shown in FIG. 4, with a plug-in head being arranged outside the toy building brick.

A toy building brick 1 (FIGS. 1, 2, 3*a*, 6) of a box of bricks-system is composed of an ashlar-shaped body 2, in which a recess 3 is being arranged. The recess 3 extends like a groove within the body 2, which is preferably made of a synthetic material. The bottom 4 of the recess 3 is of plane configuration and extends rectilineally within the body 2. The groove-shaped recess 3 is open to the upper surface 5 and against the two front sides 6, 7, and has in its longitudinal direction rectilineal, profiled sidewalls (not shown in detail). Inside the recess 3 one can see two sectors 8, 9 extending in longitudinal direction and bordering on one another with one open side. The inner sector 8 starts on the bottom 4 and extends approximately to half the height of the recess 3. Adjacent to the inner sector 8 is the outer sector 9, which is extending up to the upper side 5.

The two sectors 8, 9 are intended for receiving and arresting a plug-in head 10 being composed of a middle piece 11 and two endpieces 12, 13 bordering on that middle piece. Preferably the middle piece 11 has the form of a cylinder. The two endpieces 12, 13 preferably are truncated cones, the bases of which having the same dimensions as the front-side ends of the middle piece 11. The two endpieces 12, 13 have the same shape. The plug-in head 10 comprises outer edges 14, 15, 16, 17 running vertically to the longitudinal axis 18 of the plug-in head 10. In the position of the plug-in head 10 shown in FIGS. 1*a* and 1*b*, the longitudinal axis 18 is on a level, which in longitudinal direction divides the recess 3 into two symmetric halves. The middle piece 11 has a cylindrical outer surface 21. The endpieces 12, 13 each have a truncated cone-shaped side face 20, 23. The front surfaces 19, 22 of the endpieces, turned away from the middle piece 11, are circular and have a smaller diameter than the cylindrical middle piece. In longitudinal cross-section the plug-in head 10 is octagonal. There the distances between the edges 14 and 15 or, resp. 15 and 16, or 16 and 17 are of the same size. Between diametrically-opposite points of the edges 14 and 17 or, resp. 15 and 16, the plug-in head 10 each time has the largest diameter. The plug-in head 10 can have a size of approx. up to 5 cm and larger.

On the front surface 19 a neck 24 is positioned being of cylindrical configuration. The diameter of the neck 24 is smaller than the diameter of the front surface 19. The longitudinal axis of the neck 24 is coinciding with the longitudinal axis of the plug-in head 10. Therefore the junction point of the neck 24 with the endpiece 12 is surrounded by an annular area. The size of the annular area is defined by the ultimate strength of the seam boundary between the neck 24 and the front surface 19.

The end of the neck 24 not fastened on the plug-in head 10 is preferably joined with a toy building brick 1. Thereby the neck 24 each time can be joined with one of the front surfaces 6, 7. It is also possible to fix the neck 24 with the plug-in head 10 on the lower surface 25 of the toy building brick 1.

The cross-section of the inner sector 8 is adapted to the cross-section of the endpiece 13 and the middle piece 11, i.e. the cross-section of the inner sector 8 is equal to a trapezoid followed by a rectangle. At the upper end of the sector 8 two projections 26, 27 are projecting into the recess 3. The projections 26, 27 are arranged symmetrically to the imaginary center plane 59 dividing the recess 3 into two equal longitudinal halves, which center plane is drawn in broken lines in FIGS. 1*a*, 1*b*, and 3*a*. When the plug-in head 10 is inserted into the inner sector 8, the projections 26, 27 each engage a part of the edge 15 and thus arrest the plug-in head 10 in the inner sector 8. In this position of the plug-in head 10 the neck 24 is extending along the longitudinal axis 18 of the plug-in head. FIG. 1*a* illustrates a toy building brick 1, into the inner sector 8 of which a plug-in head 10 is inserted.

The outer sector 9 has a middle zone 28 provided with two side-walls, each of which being formed as a segment of a cylinder jacket. The diameter of these cylinder segments is a little larger than the distance between two diametrically-opposite corners of the octagonal cross section of the plug-in head 10. The zone 28 on both sides is continued each time by plane surfaces 29, extending symmetrically to the middle plane 59 of the recess 3. The distance between two surfaces 29 being symmetrically opposite to the center plane 59, is adapted to the diameter of the middle piece 11. Bordering on the inner surfaces 29 are the projections 26, 27, respectively. The surfaces 29 facing the upper side 5 are continued each time by projections 30, 31. The projections 30, 31 engage the edge 15 when a plug-in head 10 is inserted in the outer sector 9 and will arrest the plug-in head 10 in this position together with the projections 26, 27 engaging the edges 16.

In the outer sector 9, the plug-in head 10 can assume different angle positions. FIGS. 1*a* and 1*b* illustrate a position where the neck 24 is extending along the longitudinal axis 18. The plug-in head 10, however, can also be arrested in the outer sector 9 when turned for 45° as against the position shown in FIGS. 1*a* and 1*b*. Such a turned position where the neck 24 is inclined for 45° towards the center plane 59, is shown in FIG. 3*a* in broken lines.

The toy building brick 1 allows the inserting of plug-in heads 10 in the recess 3 alternatively from the front sides 6 or 7. In FIG. 2 a plug-in head 10 is shown on either side of the toy building brick 1. The plug-in heads 10 with regard to the toy building brick, are arranged at different heights, whereby it shall be expressed that from the side of the toy building brick 1 by moving in direction of the arrow 32, the plug-in heads can be pushed into the outer sector 9, and by moving in direction of the arrow 33 into the inner sector 8. When pushing in the plug-in heads, the recess 3 presents a rail-like guide along which the plug-in heads 10 can be moved into the desired position. The desired final position of the respective plug-in head 10, e.g. can be in the center of the toy building brick 1. The plug-in heads 10 can be pushed into the outer sector 9 already in the respectively desired angle position. Therefore it is no longer necessary to turn the plug-in head 10 once more after after it has been inserted in the toy building brick 1. This means that at the inserting of the plug-in heads 10, no projections 27, 26, 30, 31 must be pressed outwards. The expenditure of force for pushing in the plug-in heads 10 from the front sides 6, 7 is less than the expenditure of force for shifting the projections 26, 27, 30, 31 outwardly. In the sectors 8 and 9 the plug-in heads 10 can be easily moved from one front side 6 or, resp. 7 to the other front side. The toy building brick 1, however, has a certain tension by which the sidewalls of the recess 3 are pressing against the respective plug-in head 10 so that the plug-in head 10 is arrested in the respective position.

When the plug-in head 10 is arrested in the inner sector 8, then another toy building brick fastened on the neck 24 (not shown in detail), with its surface bordering on the neck 24 is resting against the upper side 5.

FIGS. 4 and 5 illustrate a toy building brick 34 with a cylindrical side face 35. The toy building brick 34 has a recess 3 corresponding with that one of the toy building brick 1 as far as shape and dimensions are concerned. Therefore similar elements in the FIGS. 1*a*, 1*b*, 3*a*, 4, and 5 have the same reference numbers. In the device shown in FIG. 4 the plug-in head 10 sits in the outer sector 9.

Each of the projections 30, 31 is continued by respective plane surfaces 36, 37, extending up to the upper edges 38, 39 of the recess 3. The surfaces 36, 37 are inclined toward the center plane 59 of the recess 3 in such a manner as to increase the opening between the surfaces 36, 37 in direction of the edges 38, 39. The inclination of the surfaces 36, 37 toward the center plane 59 dividing the recess 3 into two symmetric, is 45°. When a plug-in head 10 is inserted in the outer sector 9 at an inclination of the neck of 45° as against this center plane 59, the neck 24 each time is bordering on the surface 36 or 37. Such a positioned neck 24 is shown in FIG. 3*a* in dot-and-dash pattern.

When a plug-in head 10 being fastened on another toy building brick by means of a neck 24, is put into the inner sector 8 of a toy building brick 34, then the area adjacent to the neck 24 is extending between the adges 38, 39 or, resp. is resting on the edges 38, 39. When the plug-in head 10 is in the outer sector 9 (FIG. 1*b*, 4), then the surface bordering on the neck 24 of the other toy building brick is not resting on the edges 38, 39. Preferably the plug-in head 10 is inserted in an outer sector 9 in order to adjust an inclined position of the neck 24 toward the center plane 59.

In approximately the center of the toy building brick 1 and 34 a further recess 40 can be provided extending transversely to the recess 3 and cutting it under a right-angle. The width of the recess 40 is adapted to the diameter of the neck 24. It can have an even or a semi-circular bottom 41. The bottom 41 is located at the height of the inner edges of the walls shaped like a cylinder segment of the zone 28. Therefore the recess 40 is less deep than the recess 3. Like the recess 3, the recess 40, too, can move rectilineally over the entire toy building brick 1 or, resp. 34. It is therefore of groove-shaped design and is open at the front sides as well as to the top. In the sidewalls of the recesses 40 there are provided projections like e.g. bridge-shaped beads 141, 142, 143, 144, which extend at a distance to the bottom 41 of the recesses 40 so that a neck of a toy building brick can be arrested in a kind of snap joint. Thereby it is guaranteed that a neck of a building brick being inserted in the recess 40 is safely fixed in order to meet the desired play function.

The plug-in head 10 can be arranged in the outer sector 9 in such a manner that the neck 24 is projecting into the recess 40 and bordering on the bottom 41. Thereby the neck 24 has an inclination of 90° against the center plane 59. A plug-in head 10 in the above mentioned position is illustrated in the FIGS. 3*a* and 5. The thickness of the toy building brick 1 between the two outer surfaces 42, 43 of the toy building brick 1 extending on both sides parallelly to the recess 3, is adapted to the length of the neck 24 in such a manner that another toy building brick 44 being connected with the neck 24, will border on the outer surfaces 43 and 42. For toy building bricks 34 with a cylindrical outer surface, the thickness of the toy building brick 34 must be dimensioned in such a manner that the length of the bottom 41 is equal to the length of the neck 24, which on one end is connected in gravity and mechanic control to the plug-in head 10, and at the other end with another toy building brick 45. This brings about that the toy building brick 45 in the position of the plug-in head 10, as shown in FIG. 5, in the outer sector 9 along a strip 60 is bordering on the toy building brick 34, where in the range 60 a flattening can be provided for safely arresting and aligning the elements with respect to each other.

Between the upper surface 5 and the outer surfaces 42, 43 of the toy building bricks 1 and 44 each, plane surfaces 46, 47 are arranged extending over the total length of these toy building bricks. The surfaces 46, 47 each are inclined for 45° against the adjacent surfaces being rectangularly arranged with respect to each other. The width of the surfaces 46, 47 is adapted to the length of the neck 24 in such a manner that a toy building brick 44, from the lower side 48 of which a neck 24 with the plug-in head 10 is projecting, when the plug-in head 10 is inserted in the outer sector 9, can be swivelled from one into the other desired angle position. In the position of the plug-in head 10 as shown in FIG. 3*a*, the lower side 48 and the outer surface 43 are bordering on each other.

In the two walls 49, 50, each bordering on the bottom 4 of the toy building bricks 1 and 44, approximately in the center, grooves are being provided each time (51, 52), extending over the total length of the recess 3. Preferably split pins 53 are fastened on the endpiece 13 of some of the plug-in heads 10. Such plug-in heads 10 are illustrated in FIG. 2. The split pins 53 secure the plug-in heads 10 against torsion. However, it could also be desired to arrange the plug-in heads 10 rotatingly in the inner sector 8. The grooves 51, 52 enable a rotation of the plug-in heads 10 in spite of present split pins. Toy building bricks with grooves 51, 52 differ from other toy building bricks without grooves preferably by the colour. Therefore the toy building bricks provided with grooves 51, 52 can be quickly and easily identified.

FIG. 3*b* shows a device 54 comprising two plug-in heads 10, each being arranged on one end of a neck 55. It is expedient to make the length of the neck 55 twice as long as that of the neck 24. With the device 54 toy building bricks can be joined to each other without that plug-in heads 10 must be rigidly mounted on the toy building bricks.

For example, it is possible to insert the plug-in heads 10 of the device 54 each time in the inner sectors 8 of two toy building bricks with adjacent upper surfaces 5, in order to fasten these toy building bricks on one another. Likewise such toy building bricks can be arranged in inclined position to each other at the angles of 45° or 90°, if one of the plug-in heads 10 is arrested in a toy building brick in the outer sector 8 and the second one in the other toy building brick in the inner sector 9.

In FIG. 7 a toy building brick 56 is shown having a spherical outer surface 57. In the toy building brick 56 a recess 3 is provided analogically to that one in the toy building bricks 1, 34, 44, 45. Like in the above described toy building bricks 1, 34, 44, and 45, the recess 3 in the toy building brick has an outer and an inner sector 8, 9. The sectors 8, 9 show the same profile on their walls as the sectors 8, 9 of the toy building bricks 1, 34, 44, and 45.

A plug-in head 10, of which the neck 24 is shown as sectional view in FIG. 7, can be pushed into the recess 3 from the side in a direction marked by an arrow.

I claim:

1. A device comprising a toy building brick having at least one plug-in head resting on a neck and having a middle piece of constant cross-section in longitudinal direction of the neck; two endpieces with their bases each at one front surface of the middle piece, said endpieces projecting from the front surfaces of the middle piece, being of the same shape, and tapering respectively toward the free end of the plug-in head and toward the neck; the outer surface of said neck being set back relative to the outer edge of the endpiece; said plug-in head being octagonal in longitudinal cross section and adapted to be inserted into a recess in another toy building brick as well as retained alternatively in two different depths of the recess; said other toy building brick (1, 34, 44, 56) is ashlar-shaped or cylindrical in the longitudinal direction of the recess (3), said recess being of groove-like configuration and extending rectilineally in its longitudinal direction as well as being open toward the top and at the front surfaces of the toy building brick (1), said recess comprising an inner sector (8) of which the cross-sectional surface is complementary to the cross-secton of the endpiece (13) remote from the neck (24, 55) and to the cross-section of the middle piece (11), which inner sector is delimited against an outer sector (9) at the distance from the bottom (4) of the recess (3) substantially equal to the length of the middle piece (11) and one endpiece (13), said inner sector being delimited by two projections (26, 27) engaging the edge (15) of the middle piece (11), an outer sector comprising a middle zone (28) with walls being cylindrical in cross section, the diameter of said only sector being substantially equal to the distance between diametrically opposed edges and there being, at the ends of each of said middle zones, areas (29) extending respectively up to the projections (26, 27) at the inner sector and to further projections (30, 31) at the outer sector, said further projections facing away from the projections (26, 27) at the inner sector (8) and separated by a distance substantially equal to the length of the middle piece (11); between the further projections (30, 31) and edges (32, 39) of the recess (3) extending over them, plane surfaces (36, 37) are arranged flowing outwardly in the upward direction and each forming an angle of 45° C. with a plane perpendicular to the bottom (2) of the recess, that at least one other recess (40) is provided, the cross-section of which being adapted to the cross-section of the neck (24, 55), and which crosses the first recess (3) at an angle of about 90°, the bottom (41) of the additional recess (40) is substantially level with the edges of the walls of the middle zone (28).

2. The device of claim 1 comprising bead-like projections (141, 142, 143, 144) in the sidewalls of the additional recess (40), located at a distance from the bottom (41) of the additional recess (40) such that said neck is positively retained in the recess (40).

3. The device of claim 1 wherein said toy building brick (1, 44) is provided with at beveled plane surfaces (46, 47) inclined at 45° to a line perpendicular to the bottom (4) of the recess (3), said level being at least on the two outer longitudinal edges at a level with the upper opening of the recess (3).

4. The device of claim 3 wherein the thickness of the wall between the outer surface (42, 43) of the ashlar-shaped toy building brick (1, 44) and the recess (3) corresponds to the length of the neck (24).

5. The device of claim 1 wherein the thickness of the wall between the side face (35) of the toy building brick (34, 44) and the recess (3) corresponds to the length of the neck (24).

6. The device of claim 1 wherein there are two plug-in heads (10) each connected to an end of a neck (55), the length of said neck corresponding to the distance between the inner sector (8) of a first toy building brick and the outer sector of a second toy building brick, the recesses (3) of the two toy building bricks are bordering on one another in alignment.

7. The device of claim 1 wherein the area (49, 50) abutting both sides and the bottom (4) of the recess, there being (51, 52) extending in longitudinal direction of the recess (3).

8. The device of claim 1 wherein said middle piece (11) is a cylinder and the endpieces (12, 13) are truncated cones.

9. The device of claim 1 wherein said middle piece (12, 13) and the endpieces in cross-section (11) are polygonal in cross-section, said endpieces having a whole number of areas bewtween the edges.

* * * * *